United States Patent [19]

Roberts

[11] Patent Number: 4,854,107

[45] Date of Patent: Aug. 8, 1989

[54] BEAM FRAMING SYSTEM AND PROCESS

[76] Inventor: Gary L. Roberts, 639 Sedgefield Dr., Newport News, Va. 23605

[21] Appl. No.: 149,382

[22] Filed: Jan. 28, 1988

[51] Int. Cl.[4] ..... E04C 3/36; E04C 3/34

[52] U.S. Cl. ..... 52/725; 52/732; 52/DIG. 8

[58] Field of Search ..... 52/58, 105, 301, DIG. 8, 52/712, 725, 488, 732

[56] References Cited

U.S. PATENT DOCUMENTS

| | | | |
|---|---|---|---|
| 2,662,620 | 12/1953 | Vojta | 52/732 X |
| 2,720,289 | 10/1955 | Henrickson | 52/488 |
| 3,029,914 | 4/1962 | Macomber | 52/732 |
| 3,081,851 | 3/1963 | Hubbard | 52/732 X |
| 3,154,889 | 11/1964 | Monroe | 52/712 |
| 3,512,818 | 11/1968 | Pechemik | 52/DIG. 8 X |
| 4,503,652 | 3/1985 | Turner | 52/732 X |
| 4,641,474 | 2/1987 | Cannarsa | 52/714 X |

*Primary Examiner*—Carl D. Friedman
*Assistant Examiner*—Lan Mai
*Attorney, Agent, or Firm*—Wallace J. Nelson

[57] ABSTRACT

An elongated sheet metal corner framing element is provided having an essentially "E" shaped cross-sectional area. The center point of the "E" is longer than the end points and one section of the "E" is configured to engage a flange of an H- or I-beam structural member. The other section of the "E" extends from the structural beam and forms a squared open corner section along the entire beam length for attachment of wallboard thereto. The extra length center point of the "E" configuration permits shooting (with power driven pins or nails) of the corner element to the beam at spaced intervals along the element length where more than a frictional fit is desired or required. The corner element may be cold-rolled, extruded, or formed of a flat or square bottom U-channel with an uneven side sheet metal angle attached therein via spot welding or metal screws. An alternate embodiment for covering concrete columns includes an outside corner element having a cross-sectional area in the shape of an open square with ear flange extension 91,92 serving as attachments for element 80 to the concrete column.

3 Claims, 4 Drawing Sheets

FIG. 3
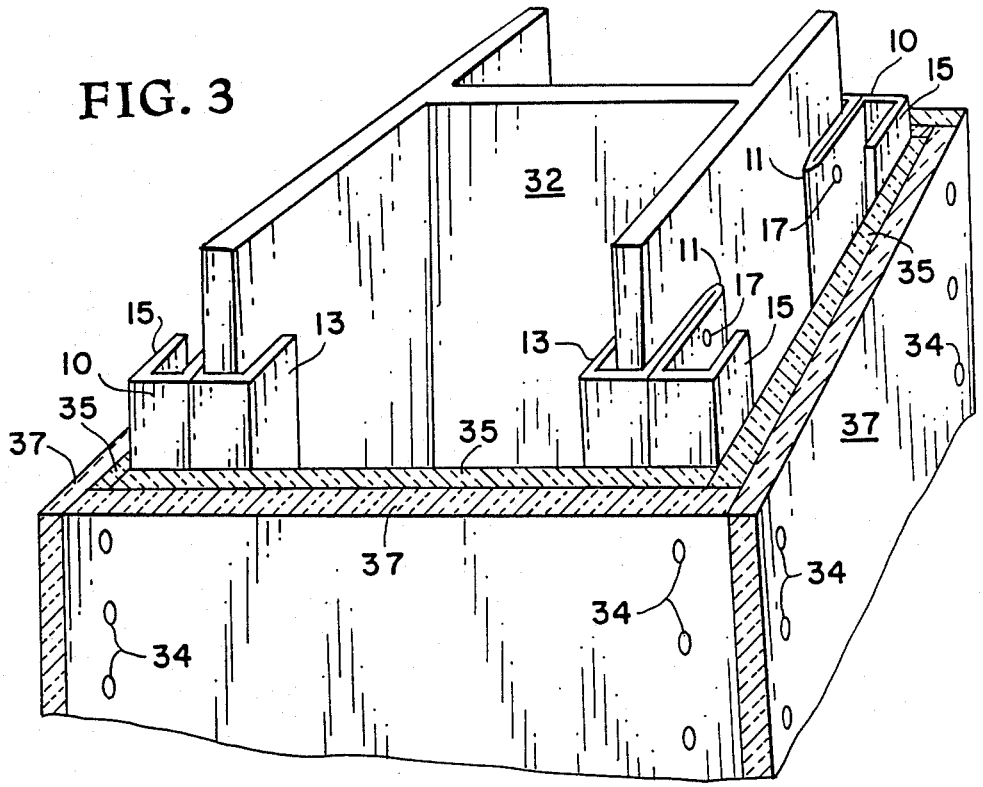
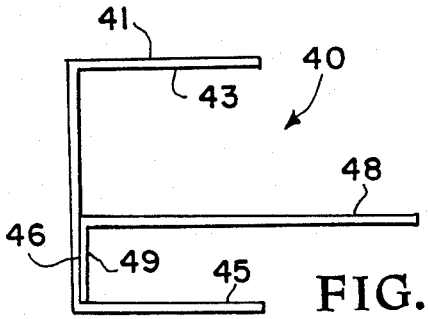
FIG. 4
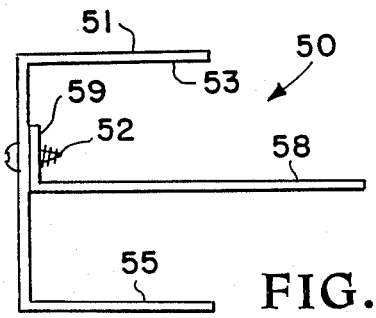
FIG. 5
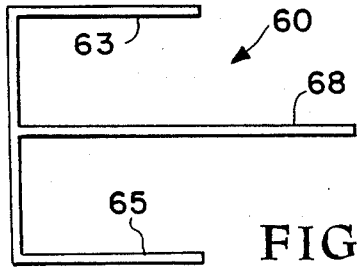
FIG. 6
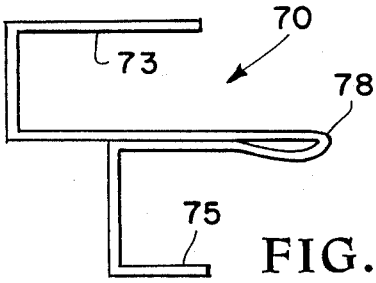
FIG. 7

BEAM FRAMING SYSTEM AND PROCESS

FIELD OF THE INVENTION

This invention relates in general to building construction and relates in particularly to a beam framing system and process for preparing structural beams for full or partial enclosure with fire-rated or other wallboard coverings.

BACKGROUND OF THE INVENTION

Commercial building codes normally require that structural columns such as standard "H" or "I" beams, as well as concrete columns, be covered or enclosed with a fire resistant or fire retardant covering. Plaster board, sheet rock, gypsum board and other similar wallboard, normally used for interior finishing are also commonly used for this purpose. The term "wallboard" as used herein is intended to be generic and to include sheet rock, gypsum board, plaster board and any other conventional fire proof or combustible wallboard covering normally used and meeting building codes in the interior finishing of building structures.

One of the frequently used methods for providing fire rated wallboard protection to a structural column involves measuring, cutting and shooting (with a nail gun) four pieces of sheet metal channel to the building ceiling surrounding the structural column to be covered. A plumb bob is then used to position four additional pieces of channel to the floor. These four pieces of channeling must also be measured, cut and shot to the floor. After the ceiling and floor channels are fixed in position, sheet metal studs are measured, cut, assembled and screwed to the ceiling and floor channels. In most situations, additional sheet metal studs are employed as cross-ties. Thus, this time-consuming process may require handling, measuring, cutting, et cetera of as many as twenty pieces of material.

Other prior art systems for attaching wallboard to structural columns involves the use of various clip structures to attach furring to the columns, the use of hat section rails attached to each of the column sides along the length thereof and the use of horizontal channels directly attached to the longitudinal columns.

SUMMARY OF THE INVENTION

It is an object of the present invention to provide a system and method for framing building structural columns to receive a full or partial covering of plaster board, gypsum board or other wallboard that utilizes the advantageous features of the prior art systems and processes while minimizing the disadvantages thereof.

Another object of the present invention is to provide a system and method for framing building structural columns that minimizes wallboard damage during building expansion and/or contraction.

A further object of the present invention is to provide a system and method for framing building structural columns that permits squared angular adjustment of the framing, as applied, to compensate for non-square structural columns.

Another object of the present invention is to provide a system and method for framing building structural columns to receive a full or partial covering of wallboard that reduces the amount of materials employed, reduces the installation time, reduces labor costs and reduces handling, measuring and on-site cutting of the materials employed.

According to the present invention the foregoing and additional objects are attained in one aspect of the present invention by providing an elongated sheet metal corner framing element having a length essentially equal to the length of the "H" or "I" beam that is to be covered and having an essentially "E" shaped cross-sectional area. The center point of the "E" is longer than the end points and one section of the "E" is configured to engage a corner of the "H" or "I" beam structural member. The other section of the "E" extends from the structural beam and forms a squared open corner section for attachment of wallboard thereto. The open corner section of the corner framing element permits angular bending or adjustment of the corner exterior to facilitate adjustment of the protective wallboard in the event the structural beam is not square. Also, the open corner section provides some flexibility to the wallboard covering during building expansion and/or contraction normally experienced during temperature fluctuations in the structure. The extra length center point of the "E" configuration permits shooting of the corner framing element to the beam at spaced intervals along the element length where more than a frictional fit is desired or required. The corner element may be extruded, cold-rolled from a single sheet metal stock, or formed from a flat-bottom, U-shaped channel with an uneven side sheet metal angle attached therein via spot welding or metal screws.

In an alternate embodiment for covering concrete columns, an elongated sheet metal corner framing element is provided having a cross-sectional area essentially in the shape of an open square with two contiguous sides thereof positioned parallel and spaced from contiguous sides of the concrete column forming a corner of the column to be covered by the wallboard. Each of these contiguous sides of the open square have an essentially half-length side extending perpendicularly from an end thereof. Each half-length side engages one of the sides of the contiguous sides of the concrete column forming a corner of the column to be covered. An extension ear flange is provided integral with and perpendicularly extending from each half-length side and provides structure for attaching the corner framing element to the concrete column via a nail gun. The angle of the contiguous sides of the elongated sheet metal corner element is adjustable to permit squaring to the wallboard covering when the concrete column is not exactly square. Additional type corner elements are employed in conjunction with this corner framing element, where interior corners are formed by the concrete column and abutting walls, and for concrete ceams disposed beneath an overhead floor.

BRIEF DESCRIPTION OF THE DRAWINGS

A more complete appreciation of the invention and many of the attendant advantages thereof will be more readily apparent as the same becomes better understood in reference to the accompanying drawings wherein:

FIG. 3 is an end perspective view, with parts broken away, illustrating a fire protective wallboard covering applied to a vertical I-beam column in accordance with the present invention;

FIG. 4 is a sectional view of another embodiment of the corner stud shown in FIG. 1;

FIG. 5 is a view similar to FIG. 4 illustrating another embodiment of the corner stud shown in FIG. 1;

FIG. 6 is a view similar to FIG. 5 illustrating another embodiment of the corner stud shown in FIG. 1;

FIG. 7 is a view similar to FIG. 6 illustrating another embodiment of the corner stud shown in FIG. 1;

DETAILED DESCRIPTION

Figure 1:
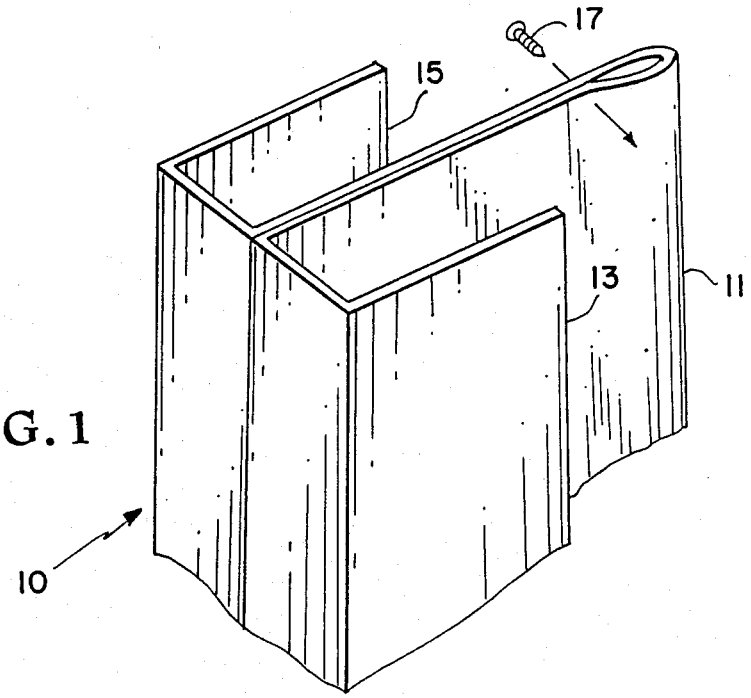
FIG. 1 is a view of a segment of the preferred embodiment of a corner stud constructed in accordance with the present invention.

Referring now to the drawings, the preferred form of the corner framing element employed in the present invention is illustrated in FIG. 1 and designated generally by reference numeral 10. As shown therein, corner framing element 10 has an essentially modified "E" shaped cross-sectional area with the center point 11 of the "E" provided with a flat side and a bulbous or enlarged loop on the other side thereof. Center point 11 is longer than end points 13 and 15 of the "E". An explosively driven nail 17 is also illustrated in FIG. 1 and serves to secure corner framing element 10 to an I- or H-beam, as will be further explained hereinafter.

As apparent in FIG. 1, the center point 11 of corner framing element 10 is twice the thickness of the remaining portions thereof. This construction is provided by utilizing the cold rolling process for construction of corner element 10 from a single piece of stock material, e.g., thin gauge galvanized sheet metal.

Figure 2:
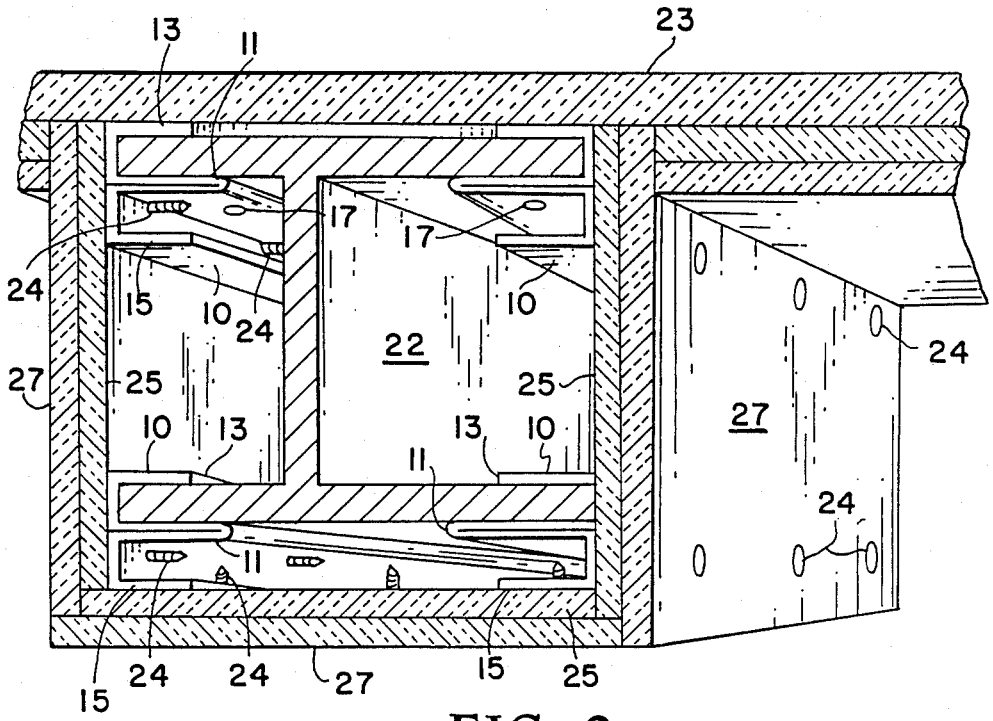
FIG. 2 is an end perspective view of an I-beam attached to a building ceiling and having a fire protective wallboard covering utilizing the corner studs shown in FIG. 1.

Referring now more particularly to FIG. 2, an end perspective view of an I-beam 22 attached to ceiling 23 is illustrated. Four corner framing elements 10 are employed as framing for attaching fire-retardant wallboard to the beam 22. One section of the framing element "E", for example that formed by center point 11 and end point 13, is configured to slip over a flange edge of I-beam 22, leaving the other segment of the "E", formed by center point 11 and end point 15, providing a squared open corner section for attaching the wallboard thereto.

Corner framing element 10 is configured to slip onto a flange of I-beam 22 by the use of hand pressure but the use of conventional hand tools, such as hammers, rubber mallets, and the like may be employed, when needed. Although this frictional fit of element 10 onto the I-beam flange is adequate in most instances, for additional ease in the wallboard installation and for added strength to the finished construction, explosively or power driven nails 17 may be shot through center point 11 into the flange of I-beam 22 by a conventional nail gun. As shown in the drawing, the tip or loop of center point 11 is directed toward the surface of the I-beam flange to be covered. This loop or bend in the point insures a gripping effect by the stud onto the I-beam flange. Also, a wider manufacturing tolerance zone in the beam grip area is permitted as well as an additional air gap to improve fire proofing characteristics of the completed enclosure. When shot with nails 17, the force of the explosively driven nails essentially draws the center point 11 against the I-beam flange along its entire length. When used, nails 17 are employed at intervals of approximately one shot or nail per two to four feet along the entire length of corner stud 10. After installation of corner elements 10 over all four flanges of I-beam 22, two layers of wallboard 25, 27 are screwed to corner element 10 via screws 24 through the squared corner section thereof, in a conventional manner. The layers of wallboard employed may vary from one to four depending upon the needs of the job.

Referring now to FIG. 3, an end perspective of a vertical I-beam 32 is illustrated wherein four corner framing elements 10 (one not visible in this FIG.) are employed as framing for attaching multi-layers of fire retardant wallboard covering thereto. Each flange of vertical I-beam 32 is provided with a frictionally-fit segment (the segment formed by points 11 and 13) of the "E" framing element 10 positioned thereon.

Power driven nails 17 are also employed to fix corner framing elements 10 relative to the flanges on I-beam 32. The remaining segment of corner elements 10, formed by points 11 and 15 of the modified "E" configuration, serves as open squared corners for attaching layers 35 and 37 of fire retardant wallboard thereto via screws 34.

Referring now to FIGS. 4-7, alternate embodiments for the corner framing elements of the present invention will now be described. Each of these corner element embodiments are also provided with modified "E" cross-sectional areas but the process for fabricating and the final configuration of the elements vary.

In FIG. 4, corner framing element 40 is formed of an elongated sheet metal framing channel 41 having an essentially squared bottom, "U"-shaped cross-sectional area and an elongated sheet metal angle strip fabricated such that one side 48 exceeds the length of sides 43, 45 of the "U" channel 41. The other side 49 of the sheet metal angle strip is designed to be essentially the same length as, or a few thousandths longer than, the width of a standard I-beam flange to aid assembly by the manufacturer. Side 49 of the sheet metal angle is connected to the interior of channel 41 by a plurality of spot welds 46 disposed at intervals along the lengths thereof.

In FIG. 5, the illustrated corner framing element 50 is formed of a channel 51, as in the previously described embodiment, with a sheet metal angle strip connected therein via screws 52. Sheet metal screws 52 are disposed at intervals along the length of, and extend through, channel 51 and the short side 59 of the angle strip. The long side 58 of the sheet metal strip is disposed spaced from an end 55 of channel 51 a distance essentially equal to the standard width of an I-beam flange to be covered by wallboard. End 59 of the sheet metal flange is directed toward end 53 of channel 51 to prevent screws 52 from contacting the I-beam flange or otherwise interfering with attachment of stud 50 to the flange.

In FIG. 6, the illustrated corner framing element 60 is formed by extrusion of aluminum or heat resistant plastic material and the entire structure, including each of the ends 63, 65 and center point 68 of the "E" configuration, are of equal thickness.

In FIG. 7, the illustrated corner framing element 70 is formed by cold rolling sheet metal stock, as in the embodiment illustrated in FIGS. 1–3. This embodiment differs in that the section of the "E" formed by center point 78 and end point 75, that is adapted to slide over a flange of an I-beam, has a depth less than that of the section formed by end point 73 and bulbous center point 78. This configuration permits the attached wallboard to be spaced further from the heat-conducting I-beam, which is an advantageous feature in some instances.

Figure 8:
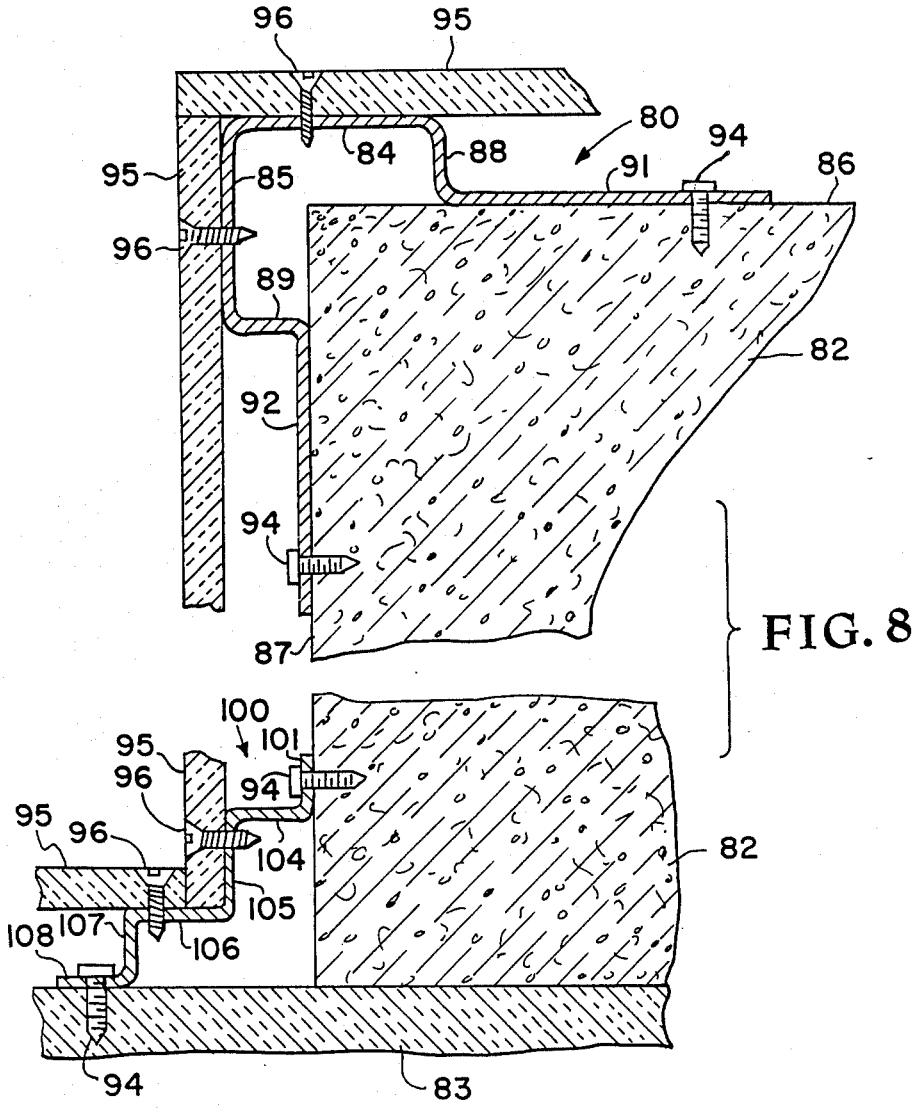
FIG. 8 is a partial end sectional view of a concrete column abutting a wall (or a concrete beam abutting a ceiling), and illustrating a modified exterior corner framing element attached to an exterior column or beam corner for securing wallboard therearound, and an elongated stepped interior corner framing element employed at an interior corner formed between the column, or beam, and the abutting wall or ceiling.

Referring now more particularly to FIG. 8, a partial end section of an embodiment of the present invention is shown as applied to a concrete column 82. In this embodiment, concrete column 82 is disposed against a concrete wall 83, although the same principle is involved when covering free-standing concrete columns, as well as concrete beams adjacent an overhead floor. Concrete columns of these types are found in new construction as well as being frequently found in renovating older buildings where new interior framing and finishes are to be installed. An exterior corner framing element, designated generally by reference numeral 80 and formed of thin sheet metal, is attached to and runs essentially from floor to ceiling along each outside corner of the concrete column 82. Where "trash" or excess concrete is left at the ends of the columns by the concrete workmen, portions of exterior corner element(s) 80 may be terminated short of the floor and/or ceiling to minimize clean-up time normally required to remove this excess concrete, as will be further explained hereinafter. Also, some of this excess concrete around the corners of the columns may be covered by the spacing between element 80 and column 82 and need not be removed. In the interest of brevity only one outside corner of column 82 and one outside corner framing element 80 is shown and described. It is to be understood however, that the other outside corner(s) of column 82 and the outside corner framing elements therefor are of identical construction. Corner element 80 has a cross-sectional area essentially in the shape of an open square with two perpendicularly disposed contiguous sides 84, 85 thereof forming a corner. Sides 84, 85 are disposed parallel with and spaced from perpendicularly disposed contiguous sides 86, 87 of concrete column 82. Sides 86, 87 form an exterior corner on column 82.

Each of contiguous sides 84,85 of element 80 is provided with a respective essentially half-length side 88,89 extending perpendicularly from an end thereof and adapted to perpendicularly extend toward contiguous sides 86,87 of column 82. A pair of extension flanges or ears 91,92 perpendicularly extend from and are integrally connected, one each, to respective half-length sides 88,89. Extension flanges 91,92 are disposed parallel with and adapted to abut respective contiguous sides 86,87 of column 82. Suitable attachment nails 94 are power driven through extension flanges 91,92 into column 82 for securing corner element 80 thereto. One or more layers of wallboard 95 is attached to the open square area of corner stud 80 via screws 96, in a conventional manner.

Corner framing element 80 is formed of thin sheet metal, e.g., 16–25 gauge sheet metal with sides 84,85 being approximately two inches in length. The shape and material of corner element 80 allow for a degree of flexibility which enables location of mounting flanges or ears 91,92 on the column face edge to correct out-of-plumbness as well as out-of-squareness of column 82. Although some of these corrections may tend to twist or otherwise distort the shape of element 80, the performance thereof is not significantly affected. After attachment, coupling between wallboard 95 and elements 80 is structurally stable and, in extreme conditions, any local distortions created in the wallboard surface during attachment may be easily "finished" out. Concrete surface conditions and local imperfections in the shape of column 82 may require additional shots through flanges 91,92. It may be necessary, in extreme conditions, to make adjustments by mechanical deformation of element 80, either by a hammer blow or palm of the hand, in conjunction with extra shots.

Poured-in-place concrete structures are typically out of plumb and square and have trash or excess concrete left at the bottom and top of the columns by the concrete finishers. Angular adjustment of corner stud 80 helps to compensate for some of this excess concrete and eliminates some of the time-consuming labor normally expended in removal thereof. Angular adjustment of corner framing element 80 is normally accomplished by attaching (shooting with a nail gun) one of the extension ears along the entire length of the concrete column 82, employing a level to check that the exterior corner formed by contiguous sides 84,85 is plumb and square, and if not, linearly moving the unattached extension ear relative to the contacting concrete column surface to make the corner plumb and square. While maintaining the corner formed by sides 84,85 plumb and square, the unattached flange or ear extension is fastened to the concrete column 82 along its entire length.

In the illustrated embodiment of FIG. 8, concrete column 82 abuts concrete wall 83 and a modified corner or stepped interior corner element 100 is employed to facilitate attachment of wall panels 95 thereto via screws 96. Stepped element 100 and corner element 80 are most efficiently manufactured by cold roll forming out of light gauge sheet metal, the same material currently used in the making of conventional track and stud framing. Stepped corner element 100 is provided with flange ends 101 and 103 attached, respectively, to column 82 and wall 83 via power driven nails 94. Side 104 of stepped element 100 is integral with and extends perpendicular from flange end 101; integral side 105 is perpendicular to side 104 and parallel to flange end 101; integral side 106 perpendicularly extends from side 105 and is parallel with side 104; and integral side 107 extends perpendicularly from side 106 parallel to side 105 and perpendicularly attached to flange end 103. Flange ends 101 and 103 and sides 104 and 107 in the preferred embodiment are approximately seven-eighths inch length in section while sides 105 and 106 are approximately one and seven-eighths inch. The thin sheet metal construction of stepped element 100 also permits angular adjustment of sides 105 and 106 when the intersecting surfaces of column 82 and wall 83 are not plumb or square. This angular adjustment is accomplished by attaching (shooting with a nail gun) one of flange ends 101 or 103 along the entire length of stepped element 100, employing a plumb line and/or level to square the intersecting surfaces of sides 105 and 106 that receive the wallboard by linearly moving the unattached flange end 101 or 103 and, while maintaining the intersecting surfaces plumb or square, fastening the unattached flange end to the concrete wall 83 or column 82 along its entire length.

Figure 9:
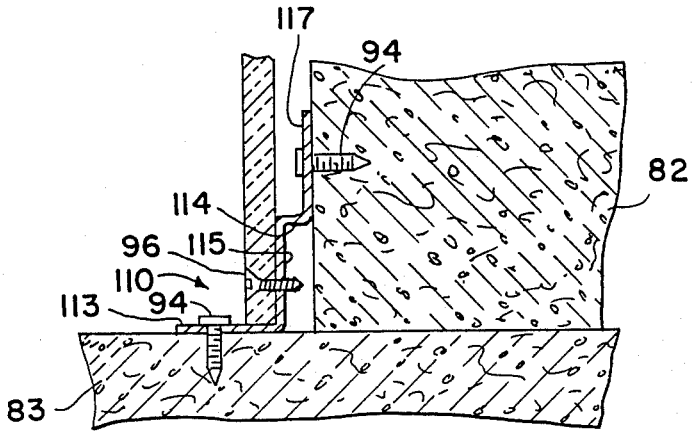
FIG. 9 is a view of an interior corner formed between a concrete column and a wall, or between a concrete beam and ceiling, and illustrating a modified stepped interior corner framing element therefor; and, FIG. 10 is a partial view of the end of the exterior corner framing element shown in FIG. 8 and illustrating an end anchoring feature therefor.

Referring now more particularly to FIG. 9, a modified inside corner element 110 is illustrated and disposed between concrete column 82 and concrete wall 83. Element 110 is similar to inside corner element 100 but has one less stepped area. Element 110 is provided with end flanges 111 and 113 attached, respectively, to concrete column 82 and concrete wall 83 via power driven nails 94. Side 114 of element 110is integral with and extends perpendicularly from end flange 111. Integral side 115 extends perpendicularly from side 114, parallel with end flange 111, and is perpendicularly attached to end flange 113. The thin sheet metal construction of inside corner element 110 also permits angular adjustment of sides 114 and 115 when the intersecting surfaces of column 82 and wall 83 are not plumb or square, as described hereinbefore in reference to FIG. 8. In each of the embodiments of FIGS. 8 and 9 the respective inside corner elements 100 and 110 provide an air gap between the wallboard and concrete column to improve the fireproofing characteristics of the completed enclosure. Also, the step configuration of elements 100 and 110 provides clearance around concrete column 82 for any concrete form leakage, as often found on inside corner surfaces, at the intersection therewith of the floor and ceiling contacting surfaces.

Figure 10:
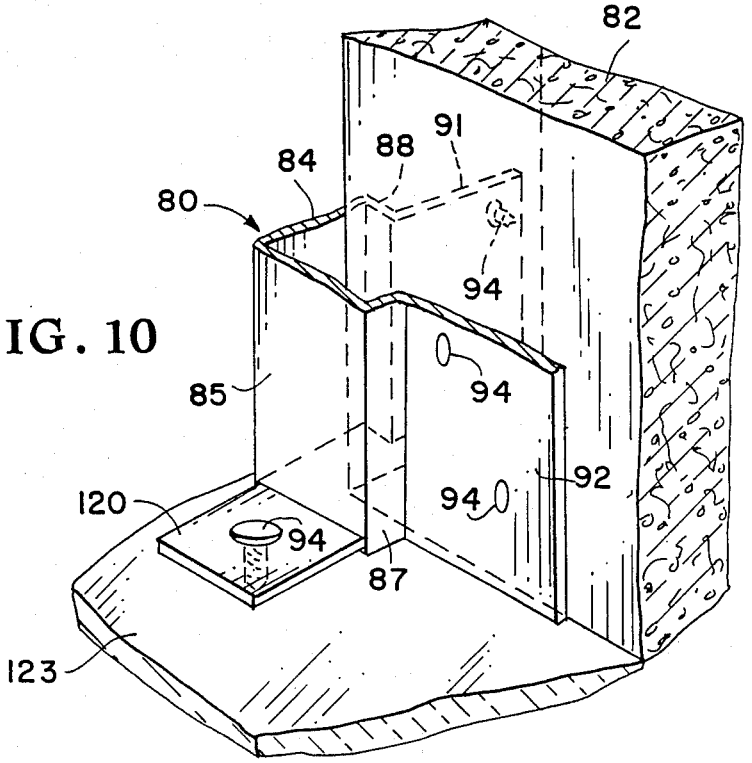

Referring now more particularly to FIG. 10, a specific connecting tab 120 is illustrated integral with and serving to secure outside corner element 80 to concrete floor 123. Tab 120 is formed as an integral part of corner element 80 and is normally folded or bent internally therein so as to be essentially flush with the inside surface of side 85. In the illustrated embodiment of FIG. 10 only one tab 120 is shown but it is to be understood that an identical tab could be formed for side 84, if so desired. When additional support for corner element 80 is desired, tab 120 is bent into the position shown in FIG. 10 and shot to floor 123 by an explosively driven nail 94'. This reinforcing connection is particularly helpful when excess concrete form leakage around column 82 is present and would require substantial time and effort for removal thereof. In this event suitable tin snips are employed to remove the end of element 80 with the exception of the side (85) having tab 120 thereon and corner element 80 is given end support through tab 120 and nail 94'. Thus, the removal of excess concrete may be restricted to only the area necessary to receive tab 120. An identical tab (not shown) is also formed on the other end of corner element 80 to permit corner element attachment to the ceiling structure when so desired. When not needed, tab 120 and the other (not shown) remain stowed within the open area of element 80. Similar tab structures may also be formed with inside corner elements 100 and 110 when so desired.

It is thus seen that installation of the framing elements of the present invention is a quick and simple process typically requiring use of only a level and a power driven nail gun. All of the studs employed have wide mounting flanges which facilitate attachment to steel and concrete structures and permit the attachment nails to penetrate a concrete column sufficiently far from the edge of the column to reduce chipping and cracking of the concrete near the edge, thereby minimizing "reshoots". Normally, one shot (nail) per two feet staggered (first one flange then the other) would be sufficient to adequately attach the outside corner element 80 or inside stepped elements 100 and 110 to the concrete surfaces. The stepped configuration of stepped elements 100 and 110 and the open square configuration of outside corner element 80 not only provide screw point clearance but also, after installation of the wallboard, provide an air gap which improves fire-proofing characteristics of the completed enclosure. Also, the shape and material of the corner elements allow for a degree of flexibility which enables location of the mounting flange on the column face edges to correct out of plumbness, as well as out of squareness, in the concrete columns. Further, the basic simplicity of the outside corner elements 80 and inside stepped elements 100 and 110, only four pieces required per column, reduces material handling and storage. This permits the elements to be delivered to the job site on size, to suit specific column length requirements, thus reducing or eliminating cutting or other processing during installation. Also, the corner elements can be manufactured in a variety of thin gauges to accommodate different installation or performance requirements.

The specific embodiments of the present invention shown and described herein are to be considered as exemplary and not exhaustive. For example, additional elements in the form of U-shaped or angle-shaped cross-ties perpendicularly disposed between the corner elements may be employed when it is anticipated that a partition wall is to be attached to an enclosed beam or column. This allows attachment of structural elements of the partition wall to the cross-ties in lieu of attachment to wallboard alone. There will be numerous other variations and modifications of the invention apparent to those skilled in the art in the light of the above teachings. It is therefore to be understood that, within the scope of the appended claims, the invention may be practiced otherwise than as described herein.

What is claimed as new and desired to be secured by Letters Patent of the United States is:

1. A framing structure for attaching protective wallboard covering to a H- or I-beam structural member comprising:

an elongated sheet metal corner element extending the length of the structural member to be covered and having an essentially "E" shaped cross-sectional area, said "E" shaped cross-sectional area of said corner element having a straight back section, a first leg perpendicularly extending from one end of said straight back section and forming one end of said "E" shaped cross-sectional area, a second leg perpendicularly extending from the other end of said straight back section and in the same direction as said first leg and forming the other end of said "E" shaped cross-sectional area, a third lege perpendicularly extending from said straight back section and disposed in spaced relationship between said first and said second legs, said third leg forming the center of said "E" shaped cross-sectional area and being longer than said first and said second legs, said first leg, said third leg and a portion of said straight back forming a first open section in said "E" shaped cross-sectional area of said corner element, said first open section of said corner element being configured to frictionally engage a flange edge of a H- or I-beam structural member, said second leg, said third leg and a portion of said straight back forming a second open section in said "E" shaped cross-sectional area of said corner element, said second open section of said corner element extending laterally from said H-or I-beam and forming a squared open corner structure for attachment of protective wallboard thereto.

2. The framing structure of claim 1 wherein said third leg center of said "E" shaped cross-sectional area terminates in an enlarged tip section, said enlarged tip section having an essentially flat side and a bulbous side, and said bulbous side facing said first open section of the "E" configured to frictionally engage the flange edge of the H- or I-beam structural member.

3. The framing structure of claim 1 wherein said elongated sheet metal corner element is formed by cold-rolling sheet metal stock and said third leg center of the "E" cross-sectional area is formed of a double layer of the sheet metal and the remaining portions of the "E" are formed of a single layer of the sheet metal.

* * * * *